US007694952B2

(12) United States Patent
Sosnowski et al.

(10) Patent No.: US 7,694,952 B2
(45) Date of Patent: Apr. 13, 2010

(54) PRINT MEDIA BIN

(75) Inventors: Luke P. Sosnowski, Vancouver, WA (US); Allan G. Olsen, Vancouver, WA (US); Wesley R. Schalk, Vancouver, WA (US); Gary T. Strowe, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 294 days.

(21) Appl. No.: 11/633,965

(22) Filed: Dec. 5, 2006

(65) Prior Publication Data

US 2008/0128975 A1 Jun. 5, 2008

(51) Int. Cl.
*B65H 5/26* (2006.01)

(52) U.S. Cl. ..... 271/9.11; 271/9.01

(58) Field of Classification Search ..... 271/9.01, 271/9.05, 9.07, 9.08, 9.11, 9.13
See application file for complete search history.

(56) References Cited

U.S. PATENT DOCUMENTS

| | | | | |
|---|---|---|---|---|
| 4,307,800 | A * | 12/1981 | Joa | 198/374 |
| 5,145,160 | A * | 9/1992 | Nagashima et al. | 271/9.09 |
| 5,957,447 | A * | 9/1999 | Sekine | 271/9.09 |
| 6,406,201 | B1 | 6/2002 | Beretta et al. | |
| 2005/0236759 | A1 | 10/2005 | Acton | |

* cited by examiner

*Primary Examiner*—Patrick H Mackey
*Assistant Examiner*—Michael C McCullough

(57) ABSTRACT

A print media bin operatively coupled to a media handling system is disclosed. In one embodiment, the print media bin includes a first tray positioned adjacent to a second tray and a media tray drive subsystem coupled to the first tray for allowing the print media bin to rotate in order to provide access to the second tray. The media tray drive subsystem includes a drive cluster gear and a tray lock, including an anti-rotation rib and a lock latch, operatively coupled to the drive cluster gear.

8 Claims, 12 Drawing Sheets

110

111

113

114

PRINT MEDIA BIN

BACKGROUND

In prior media tray systems, if the user fails to properly engage the media tray, media may be pulled from the main media tray and the print may be made on media that it is probably not intended for. This wastes media and ink/toner and frustrates the user because the desired media was not used. Conversely, if the media tray was not disengaged after printing a specialized media, the next print job may pull that media from the media tray and use it, thereby wasting ink/toner and media. Consequently, a more advantageous system, then, would be provided if such user frustration and ink/toner and media waste could be reduced.

DETAILED DESCRIPTION

Figure 1:
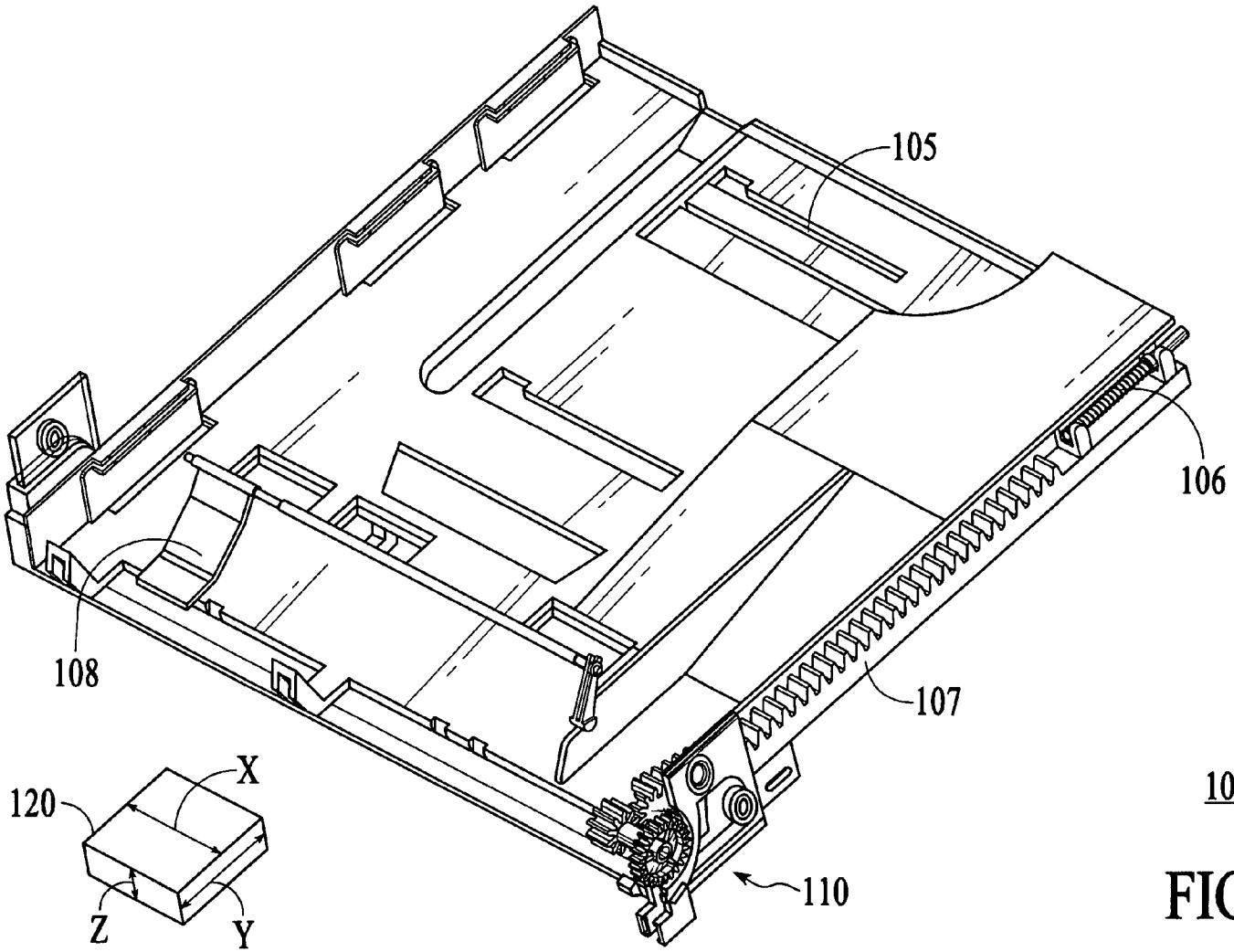
FIG. 1 illustrates a print media bin in accordance with an embodiment of the present invention.

As shown in the drawings for purposes of illustration, a print media bin is disclosed. In an embodiment, the print media bin is designed to be utilized in conjunction with a media handling system such as a printer or similar printing type device. The print media bin includes a first media tray positioned adjacent to a second media tray and a media tray drive subsystem coupled to the first media tray wherein the media tray drive subsystem includes a means for allowing the print media bin to rotate and thereby allowing access to the second media tray.

In an embodiment, the first media tray is designed to be used as a photo tray in conjunction with photo media and the second media tray is designed to be used as the main media tray in conjunction with a main media. However, a variety of different media may be employed.

Accordingly, by allowing the print media bin to rotate, the user is allowed access to the main media and is thereby provided with access to more than one print media in the printer bin. The bin can also be removed if needed. Furthermore, the print media bin can be driven and locked in position using a single motor as opposed to two motors.

Figure 1A:
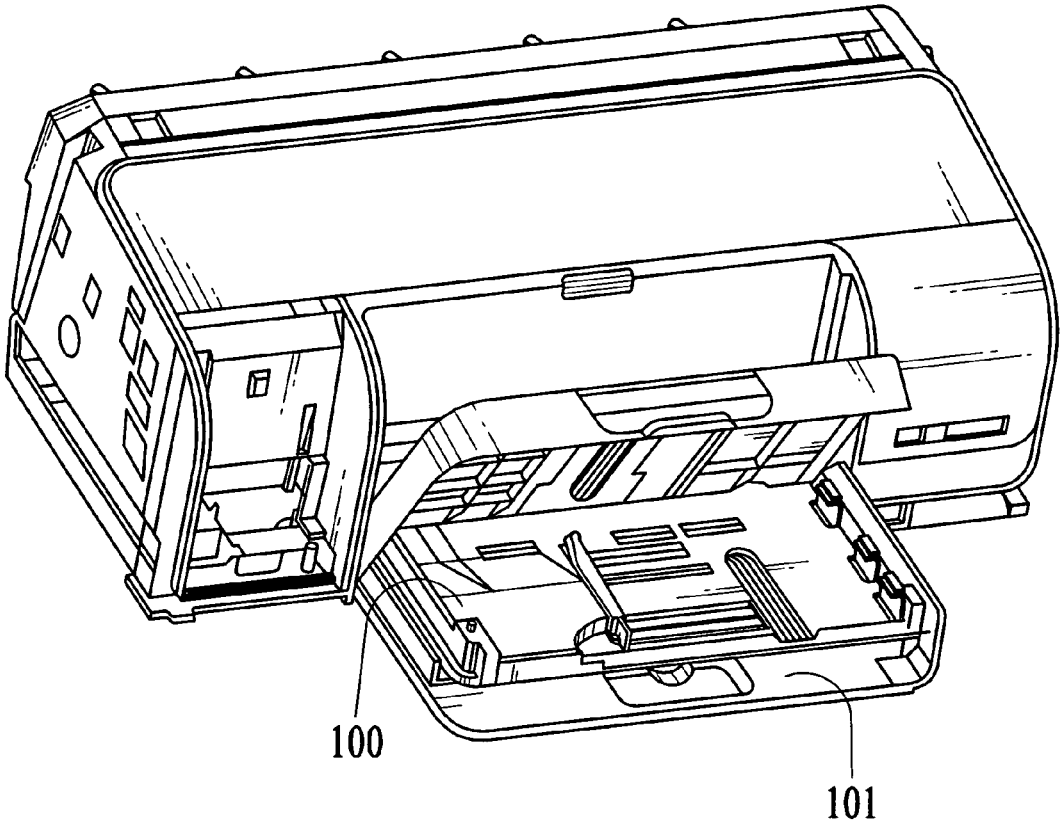
FIG. 1A shows the print media bin adjacent to a main media tray in accordance with an embodiment of the present invention.
Figure 1B:
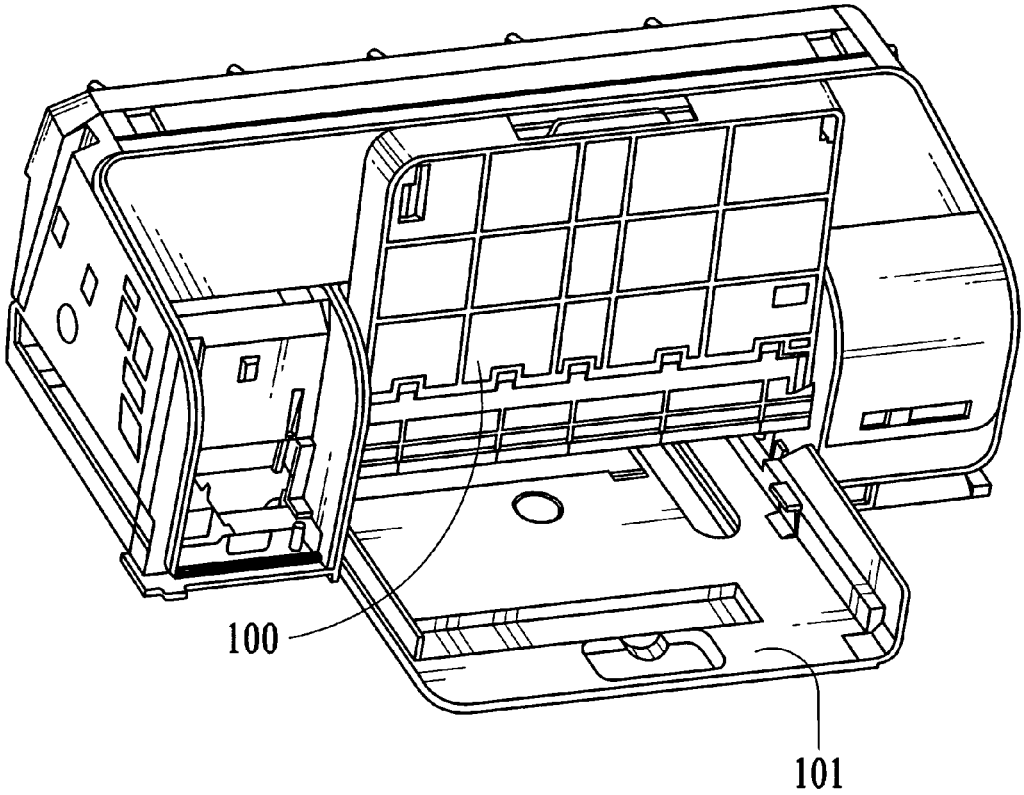
FIG. 1B shows the print media bin after being rotated in accordance with an embodiment of the present invention.

FIG. 1 illustrates a print media bin 100 in accordance with an embodiment. The bin 100 includes a print media tray 105 and a media tray drive subsystem 110 coupled to the print media tray 105 wherein the media tray drive subsystem 110 includes a means for allowing the print media tray 105 to rotate and thereby provide access to the main media tray. Also shown in FIG. 1 is the preload spring holder 106, the media tray rack 107 and a media retainer 108. FIG. 1A shows the print media bin 100 adjacent to a main media tray 101 and FIG. 1B shows the print media bin 100 after being rotated thereby providing access to the main media tray 101.

Referring back to FIG. 1, this application may reference the coordinate system used in the media handling system, the origin of which is the center of the media handling system when looking at the front of the media handling system. Accordingly, FIG. 1 shows a reference coordinate system 120. From the center, the +X direction is to the right and +Y direction is to the rear. The Z direction is vertical, with +Z in the upward direction.

The media tray drive subsystem 110 powers the print media bin 100 and allows the user to choose media from the print media bin 100 instead of the main media tray. Consequently, the selection can be made from either the driver or a button on the media handling system. In either case, the movement of the print media bin 100 occurs via the media tray drive subsystem 110.

Figure 2:
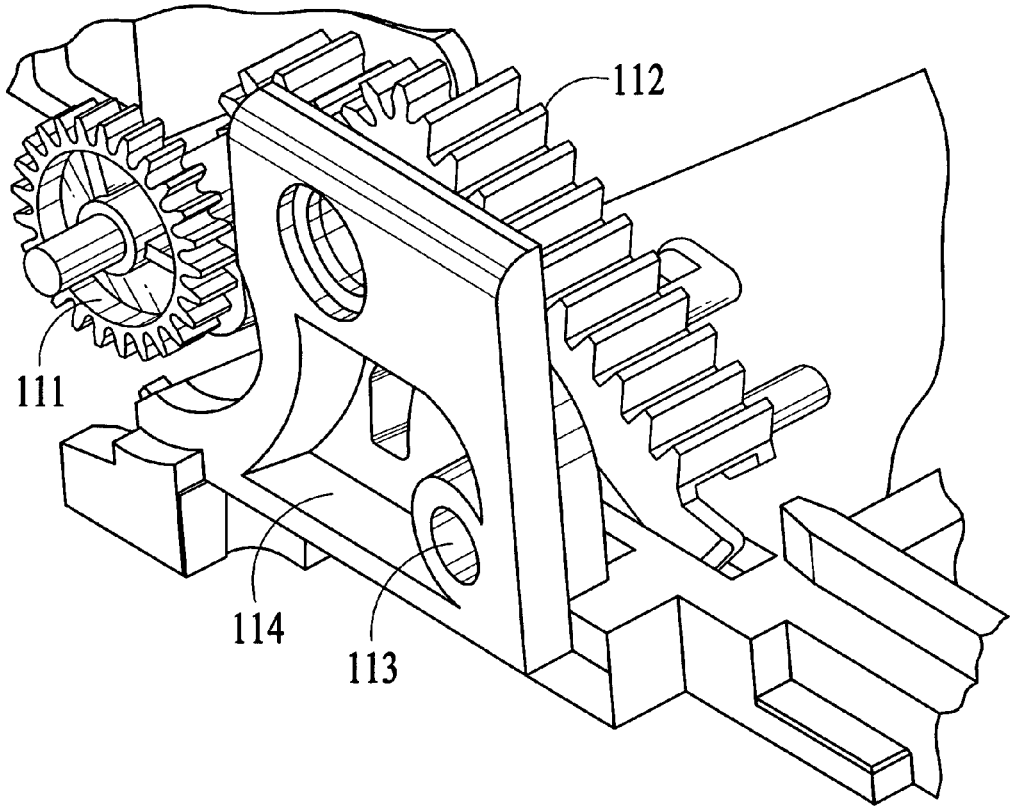
FIG. 2 shows a perspective view of the media tray drive subsystem in accordance with an embodiment of the present invention.

In an embodiment, the media tray drive subsystem 110 is a mechanical subsystem driven by a geartrain coupled to the print media bin 100. There are no sensors other than firmware that monitors the print motor and the movement distances. FIG. 2 shows a perspective view of the media tray drive subsystem 110 in accordance with an embodiment. The media tray drive subsystem 110 includes a drive cluster gear 111, a tray lock 112, a tray lock lever 113 and a media tray lock guide 114.

Figure 3:
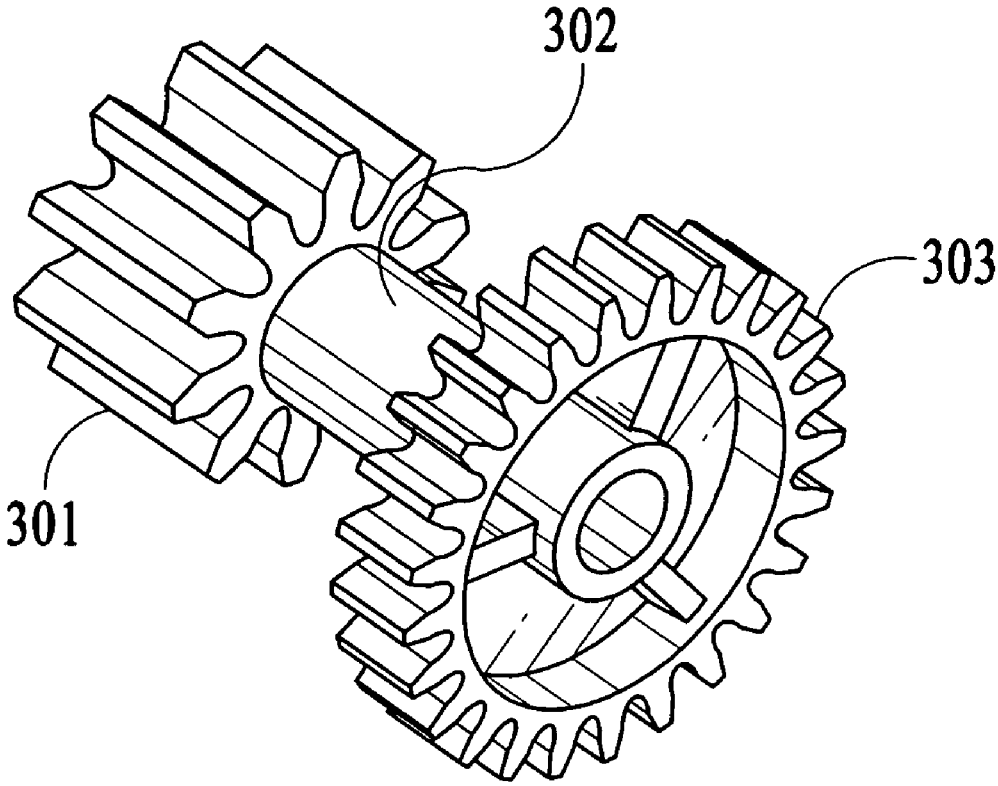
FIG. 3 shows a perspective view of the drive cluster gear in accordance with an embodiment of the present invention.

FIG. 3 shows a perspective view of the drive cluster gear 111 in accordance with an embodiment. The drive cluster gear 111 transfers rotational motion from the geartrain to a media tray rack 107. The drive cluster gear 111 includes a first gear pinion 301, a shaft 302 and a second gear pinion 303 wherein the first gear pinion 301 is smaller than the second gear pinion 303. The first gear pinion 301 is designed to push the tray lock 112 into a platen hook (not shown) to stall the drive mechanism when the media bin 100 is fully disengaged while the second pinion gear 303 couples with the left side gear train (not shown).

Figure 4:
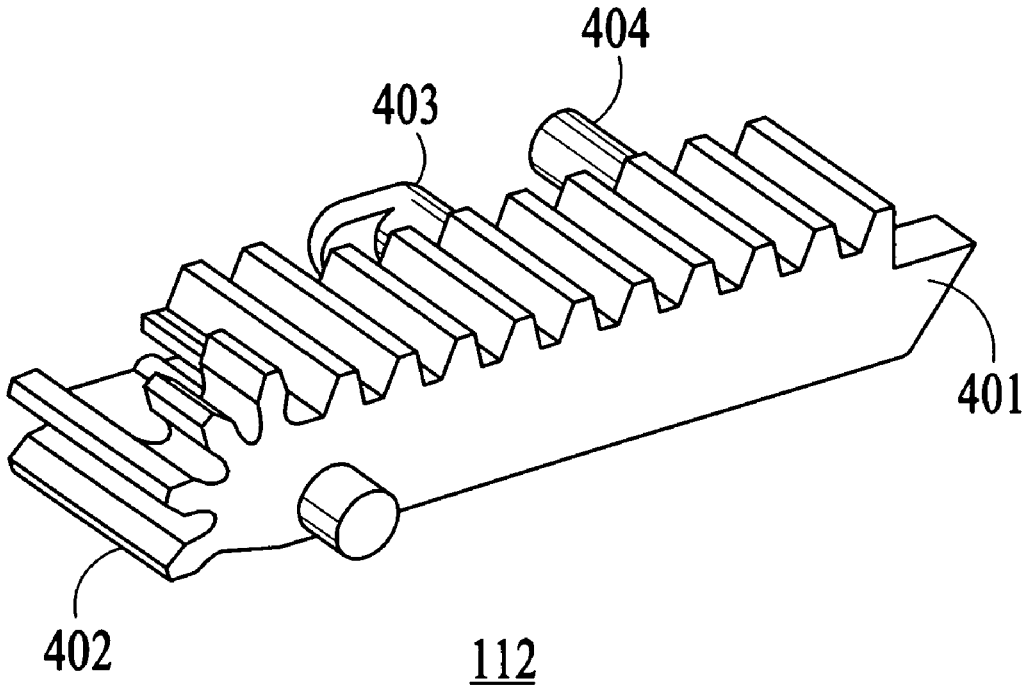
FIG. 4 shows a perspective view of the tray lock in accordance with an embodiment of the present invention.

FIG. 4 shows a perspective view of the tray lock 112 in accordance with an embodiment. The tray lock 112 retains the print media bin 100 inside the media handling system when the print media bin 100 is in a disengaged state. The tray lock 112 includes an anti-rotation rib 401, a lock latch 402, a retaining hook 403 and a pivot shaft 404. During engagement, the tray lock 112 is moved by the drive cluster gear 111 from a locked position into alignment with the media tray rack 107.

Figure 4A:
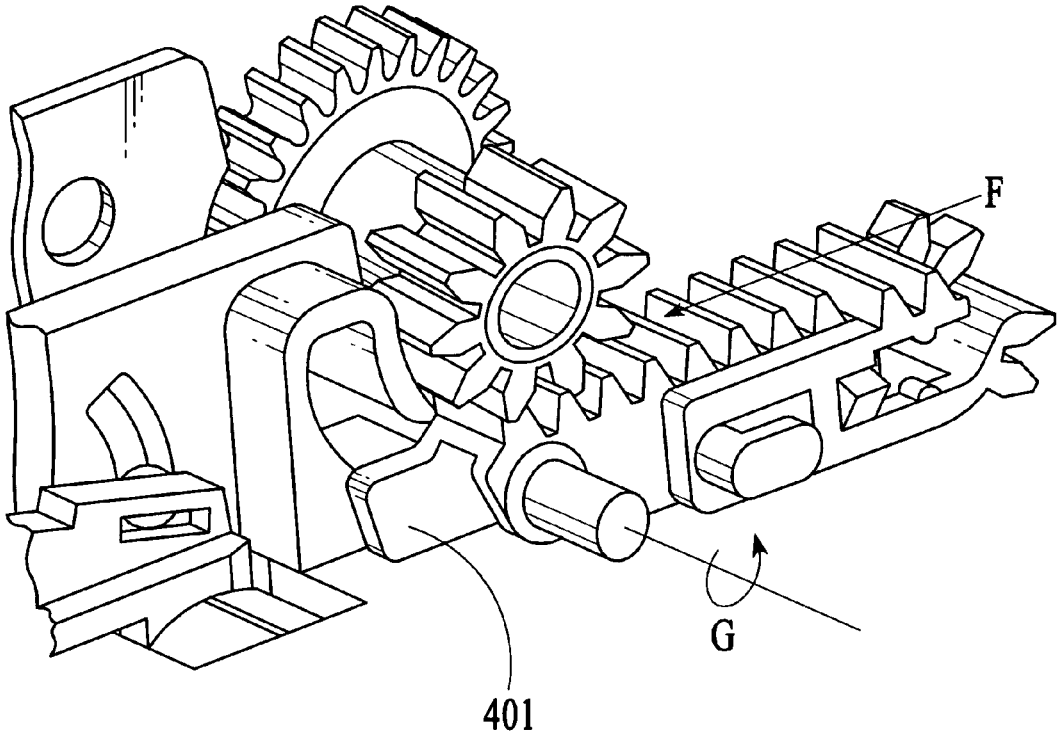
FIG. 4A illustrates the anti-rotation rib in conjunction with moment G induced by a drive force F in accordance with an embodiment of the present invention.

The anti-rotation rib 401 is designed to resist the moment induced by the drive force acting on the tray lock 112 when the tray is being disengaged. FIG. 4A illustrates the anti-rotation rib 401 in conjunction with moment G induced by a drive force F in accordance with an embodiment. Without the anti-rotation rib 401, the lock 112 may rotate to the point where the teeth are skipping against the drive gear 111. This is a concern with the first few teeth on the tray lock 112.

Figure 5:
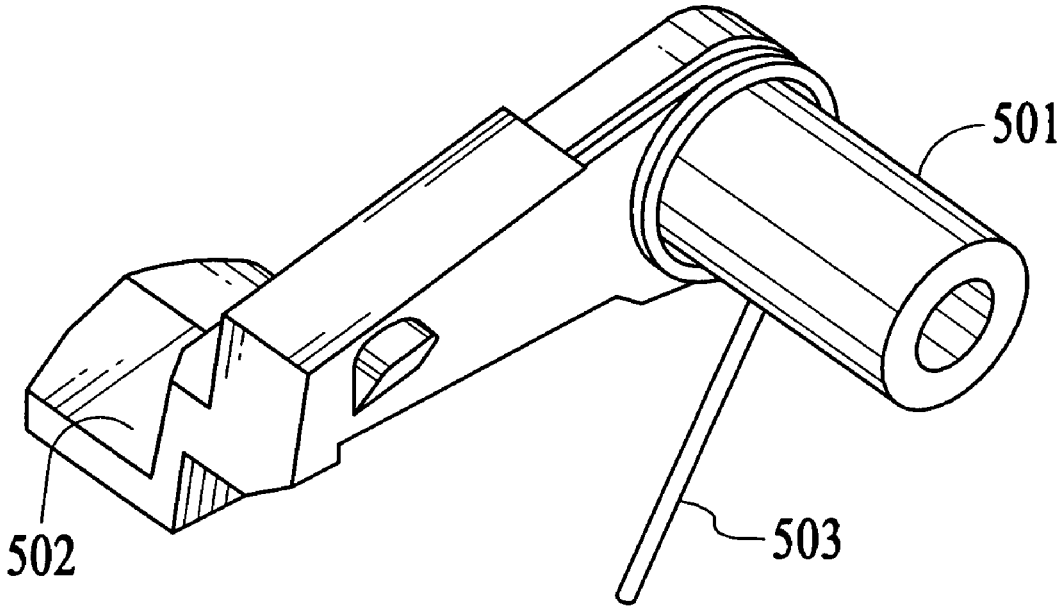
FIG. 5 shows a perspective view of the tray lock lever in accordance with an embodiment of the present invention.

FIG. 5 shows a perspective view of the tray lock lever 113 in accordance with an embodiment. The tray lock lever 113 includes a lock lever shaft 501, a lifting rib 502 and a lock lever spring 503. The tray lock lever 113 is designed to keep the tray lock 112 in the locked position while the media bin 100 is being used. The tray lock lever 113 offers enough resistance to overcome the mass of the lock 112. When the print media tray 105 is actuated, the tray lock lever 113 folds flat under the tray lock 112 and media tray rack 107.

Figure 6:
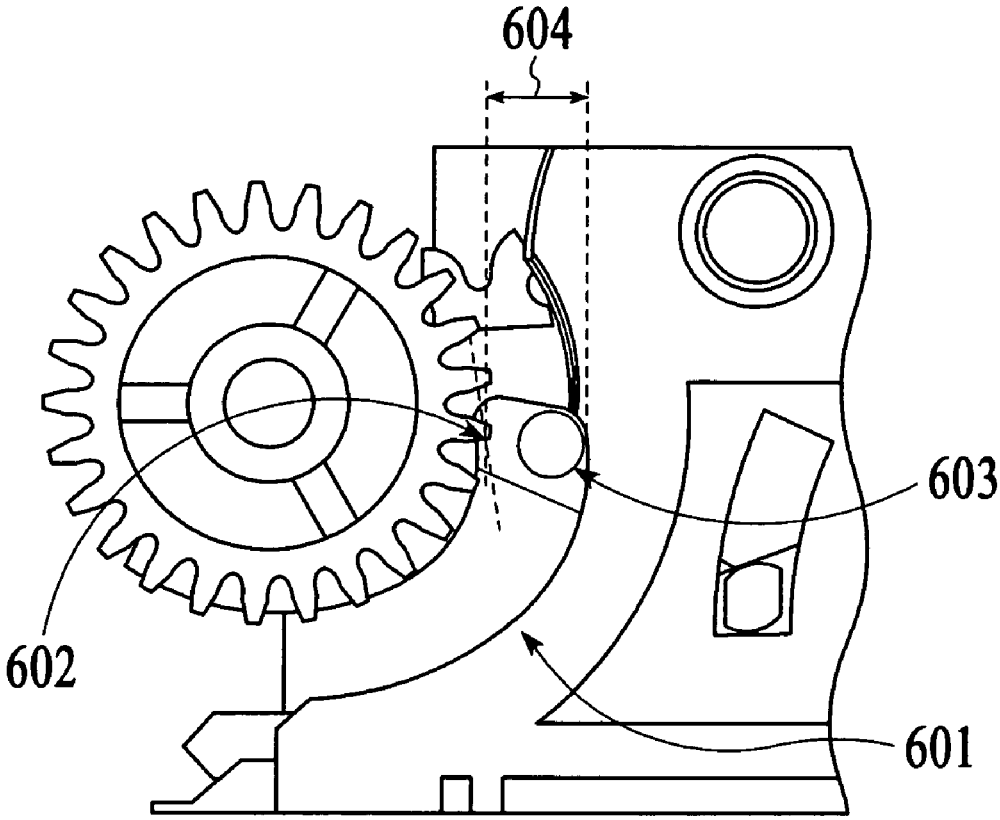
FIG. 6 shows a perspective view of the media tray lock guide in accordance of with an embodiment of the present invention.

FIG. 6 shows a perspective view of the media tray lock guide 114 in accordance with an embodiment. The media tray lock guide 114 includes a guide slot 601. The guide slot 601 leads the tray lock 112 along a path that roughly ensures engagement with the cluster gear 111. In addition, the slot acts as a cam stop for the tray lock 112 once the tray lock 112 is in a lifted position. The line of action of force 603, applied by preload spring holder 106 acting along the length of the bin 100 traps the lock 112 in a slot pocket 602 whereby a downward force applied by the cluster gear 111 can unlatch the lock 112.

Figure 7:
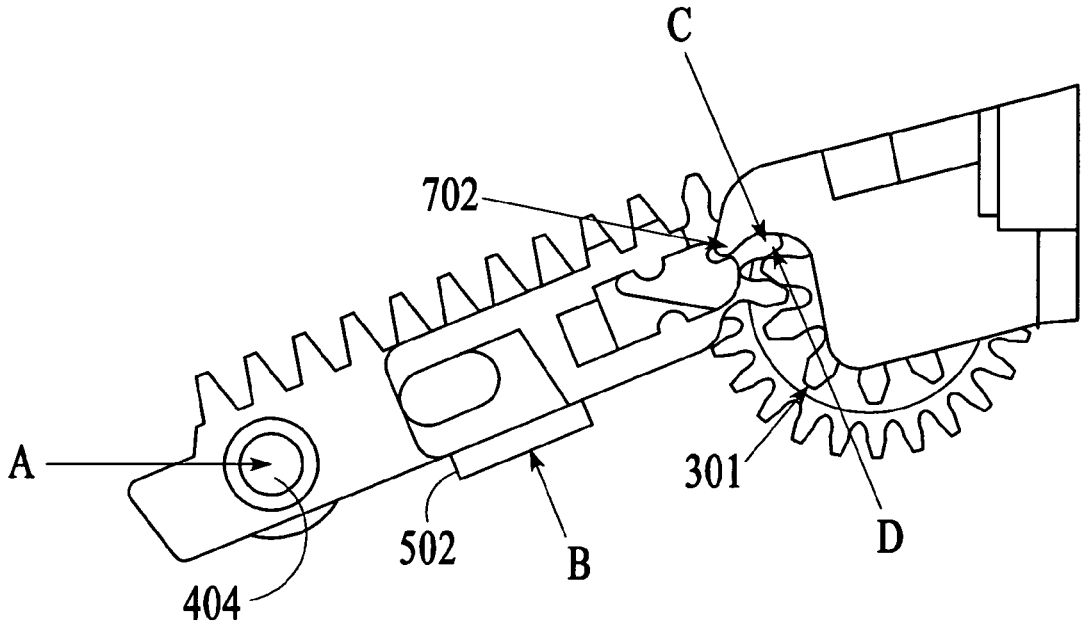
FIG. 7 shows a perspective view of the media tray drive subsystem gearing components in accordance with an embodiment of the present invention.

As previously articulated, the media tray drive subsystem 110 powers the print media bin 100 and allows the user to choose media from the print media tray 105 instead of the main media tray 101. For a better understanding of this concept, please refer now to FIG. 7. FIG. 7 shows a perspective view of the media tray drive subsystem gearing components in accordance with an embodiment. Shown in FIG. 7 are tray lock 112, lifting rib 502, first gear pinion 301, gear latch 402, platen hook 702 and pivot shaft 404.

The lifting rib 502 applies a lifting moment B to the tray lock 112 in order keep the tray lock 112 in a locked state when desired. The first gear pinion 301 drives the lock 112 into the platen hook 702 to stall the driving mechanism without skipping at the end of the disengagement move. Gear tooth skipping would occur if the drive force D were not balanced by the reaction force C.

The platen hook 702 provides an opposing surface at a normal angle to the drive force D created by the first gear pinion 301. Consequently, the platen hook 702 stops the rotating movement of the tray lock 112 when the opposing force C is equal to D. Platen hook 702 is employed because the long tolerance loop between the cluster gear 111 and the tray lock 112 does not have sufficient stiffness to stall the cluster gear 111 rotation. Without the platen hook 702, gear skip would occur at the end of the move.

The tray lock pivot shaft 404 provides the axis about which the tray lock 112 rotates. Also, this is where the force A pushes the tray lock 112 into contact with the cluster gear 111 in the Y-direction thereby allowing for much greater tolerances of engagement in the Y-direction.

The media tray drive subsystem 110 is intended to move the print media bin 100 from an external loading and storage position to an internal picking position. The motions of the media bin 100 are powered by the means of a power takeoff from the left transmission. Unlike photo bins used in previous products, this drive system allows the bin to be removable, thereby giving much better access to a main tray below. The normal operation can be divided into three modes: loading and rest, engagement and disengagement, and picking and printing.

Loading and Rest

During this operational state, the bin 100 is in a disengaged position and the tray 105 can be loaded with media and unloaded. In this state, the entire tray bin can be rotated and/or removed for better access to an adjacent main tray. During handling, the tray 105 retains media against normal handling loads and orientations through the employment of the media retainer 108.

Figure 8:
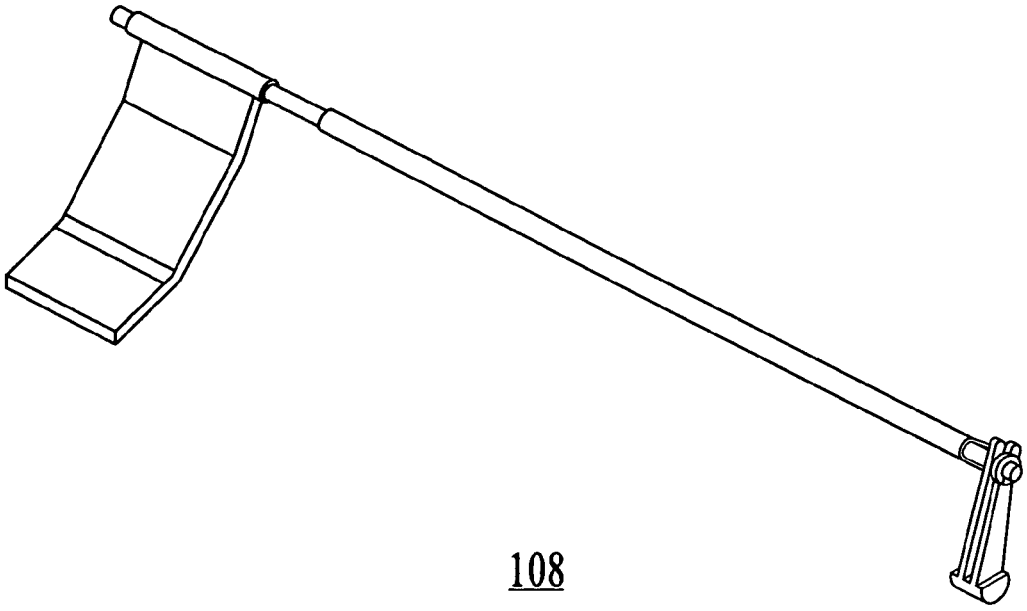
FIG. 8 shows a perspective view of the media retainer in accordance with an embodiment of the present invention.

FIG. 8 shows a perspective view of the media retainer 108. The media retainer keeps the media biased in the −Z direction in the tray 105 while the bin 100 is disengaged. This prevents the media from falling out when the bin 100 is lifted up or removed. The media retainer 108 rotates up when the bin 100 is moving inward to avoid dragging on the top of the media stack.

Engagement and Disengagement

During this operational state, the bin 100 is moving based on actuation by the media tray drive mechanism. This mechanism relies on servo feedback and firmware to sense move completion. In this state, the bin 100 cannot be removed. This actuation involves the preload spring holder 106.

Figure 9:
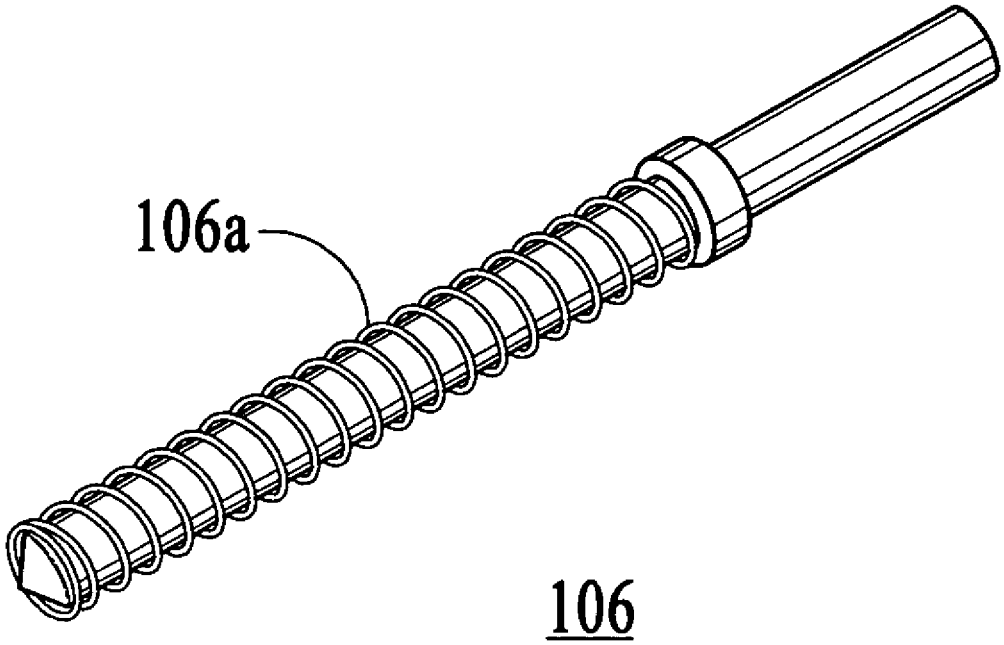
FIG. 9 shows a perspective view of the preload spring holder in accordance with an embodiment of the present invention.

FIG. 9 shows a perspective view of the preload spring holder 106 in accordance with an embodiment. Also shown is the preload spring **106*a*. The preload spring 106*a* is held in place by the preload spring holder 106. The spring 106*a* biases the holder in the −Y direction. When the bin 100 is in the disengaged position, the preload spring holder 106 is pushed in the +Y direction. It is held in this state by the tray lock 112 while simultaneously biasing the lock 112** in the +Y direction.

Since the tray lock 112 has nominal float in the Y direction, the biasing force allows significant tolerance in engagement between the bin 100 and the rest of the printer. During the engage move, the expanding spring **106*a* pushes the bin 100 in the first ~10 mm in the +Y direction, overcoming the drive angle of the tray lock 112 and the drive cluster gear 111** interface.

Picking and Printing

During this operational state, the bin 100 is engaged and stationary whereby media can be picked from the tray 105. In this state, the bin 100 cannot be removed and the bin 100 will stay engaged until the print job is complete or a fault is detected.

As shown in the drawings for purposes of illustration, a print media bin for a media handling system is disclosed. In an embodiment, the media handling system is a printer or similar printing type device whereby the print media bin includes a print media tray positioned adjacent to a main media tray and a media tray drive subsystem coupled to the print media tray wherein the media tray drive subsystem includes a means for allowing the print media tray to rotate thereby allowing access to the main media tray for loading. The tray can also be removed if needed. Furthermore, the print media tray can be driven and locked in position using a single motor as opposed to using separate motors for driving and locking the media tray.

Without further analysis, the foregoing so fully reveals the gist of the present inventive concepts that others can, by applying current knowledge, readily adapt it for various applications without omitting features that, from the standpoint of prior art, fairly constitute essential characteristics of the generic or specific aspects of this invention. Therefore, such applications should and are intended to be comprehended within the meaning and range of equivalents of the following claims. Although this invention has been described in terms of certain embodiments, other embodiments that are apparent to those of ordinary skill in the art are also within the scope of this invention, as defined in the claims that follow.

The invention claimed is:

1. A print media bin operatively coupled to a media handling system comprising:

a first tray positioned adjacent to a second tray; and a media tray drive subsystem coupled to the first tray for allowing the print media bin to rotate in order to provide access to the second tray wherein the media tray drive subsystem further comprises a drive cluster gear; and a tray lock operatively coupled to the drive cluster gear wherein the tray lock comprises a body having a first end and a second end opposite the first end;

an anti-rotation rib formed on the first end of the body and part of the body; and a lock latch formed on the second end of the body and part of the body.

2. The print media bin of claim 1 wherein the first tray comprises a specialized media print tray and the second tray comprises a main media tray.

3. The print media bin of claim 1 wherein the print media bin is removable from the media handling system.

4. The print media bin of claim 1 wherein the media handling system further comprises a printing apparatus.

5. The print media bin of claim 1 wherein the media tray drive subsystem further comprises:

a tray lock lever; and a media tray lock guide coupled to the tray lock lever.

6. The print media bin of claim 5 wherein the drive cluster gear further comprises:

a first gear pinion;

a second gear pinion; and a gear shaft operatively coupled to the first and second gear pinion wherein the first gear pinion is smaller than the second gear pinion.

7. The print media bin of claim 5 wherein the tray lock lever further comprises a lock lever shaft.

8. The print media bin of claim 5 wherein the media tray lock guide further comprises:

a guide slot for leading the tray lock along a path that ensures engagement with the cluster gear; and a slot pocket whereby a downward force applied by the cluster gear can unlatch the tray lock.

* * * * *